United States Patent [19]

Watanabe et al.

[11] Patent Number: 4,992,832

[45] Date of Patent: Feb. 12, 1991

[54] DEVELOPING APPARATUS WITH A DEVELOPER REGULATING MEMBER

[75] Inventors: Takeshi Watanabe, Toyonaka; Kikunosuke Tsuji, Sakai; Masahiko Sakae, Ikoma; Setsuo Hori, Izumi; Satoshi Kuroyanagi, Kaminoyama; Yoshiyuki Uehara, Sakai, all of Japan

[73] Assignee: Mita Industrial Co., Ltd., Osaka, Japan

[21] Appl. No.: 435,929

[22] Filed: Nov. 14, 1989

[30] Foreign Application Priority Data

Nov. 15, 1988 [JP] Japan ..... 63-288243

[51] Int. Cl.[5] ..... G03G 15/06

[52] U.S. Cl. ..... 355/259; 118/661; 355/245

[58] Field of Search ..... 355/259, 253, 251, 245; 118/661, 651

[56] References Cited

U.S. PATENT DOCUMENTS 4,370,049 1/1983 Kuge et al. ..... 355/259 X
4,385,829 5/1983 Nakahata et al. ..... 355/259 X
4,480,911 11/1984 Itaya et al. ..... 355/259 X
4,710,015 12/1987 Takeda et al. ..... 355/259

FOREIGN PATENT DOCUMENTS 0231560 12/1984 Japan ..... 355/259
61-267771 11/1986 Japan .
0024283 2/1987 Japan ..... 355/259

*Primary Examiner*—A. T. Grimley
*Assistant Examiner*—Thu Anh Dang
*Attorney, Agent, or Firm*—Armstrong, Nikaido, Marmelstein, Kubovcik & Murray

[57] ABSTRACT

A developing apparatus includes a developing roller which conveys developer on the surface thereof by the rotation in a predetermined direction. The developer conveyed thereon to develop a latent image formed on an image-holding device. A supply roller rotates keeping contact with the developing roller and by the rotation of which the developer is supplied to the developing roller. A regulating member regulates the amount of the developer to be conveyed on the surface of the developing roller. The supply roller is so disposed that the axis thereof is positioned lower than that of the developing roller while the top thereof is also positioned lower than that of the developing roller.

1 Claim, 1 Drawing Sheet

DEVELOPING APPARATUS WITH A DEVELOPER REGULATING MEMBER

BACKGROUND OF THE INVENTION

1. Field of the Invention

The present invention relates to a developing apparatus which is used in an electrophotographic copying machine or the like, and more particularly to a developing apparatus in which the amount of developer to be conveyed on the surface of a developing roller is regulated by a regulating member so that the developer is formed into a layer of a predetermined thickness for developing a latent image formed on an image-holding means such as a photosensitive drum or the like.

2. Description of the Prior Art

A developing apparatus which is used in an electrophotographic copying machine or the like is disclosed in, for example, Japanese Laid-Open Patent Publication No. 61-267771. The developing apparatus disclosed in the above patent publication includes a developing roller which delivers developer to an image-holding means such as a photosensitive drum or the like, and a supply roller disposed in contact with the developing roller for supplying developer to the developing roller. The axis of the supply roller is positioned lower than that of the developing roller, while the top of the supply roller is positioned higher than that of the developing roller.

In such a developing apparatus, the developer delivered to the supply roller is conveyed on the surface of the supply roller, and falls from the top thereof onto the developing roller positioned lower than the supply roller. The developer that falls down onto the surface of the developing roller is conveyed on the surface thereof toward the image-holding means by the rotation of the developing roller. The amount of the developer to be conveyed on the developing roller is regulated by a regulating member disposed above the developing roller, so that the developer is formed into a thin layer to be conveyed on the surface of the developing roller. Then, the developer in the form of a thin layer develops a latent image formed on the image-holding means. On the other hand, the regulating member prevents further transportation of some of the developer when it regulates the amount of the developer to be conveyed on the developing roller as described above. Accordingly, the developer which is kept back by the regulating member accumulates on the upper part of the surface of the developing roller, so that there is a possibility that the accumulated developer will collect into a lump (i.e., blocking of the developer).

SUMMARY OF THE INVENTION

The developing apparatus of this invention, which overcomes the above-discussed and numerous other disadvantages and deficiencies of the prior art, comprises: a developing roller which conveys developer on the surface thereof by the rotation in a predetermined direction, developer being conveyed thereon to develop a latent image formed on an image-holding; a supply roller which rotates keeping contact with developing roller and by the rotation of which developer is supplied to developing roller; and a regulating member which regulates the amount of the developer to be conveyed on the surface of the developing roller, wherein supply roller is so disposed that, the axis thereof is positioned lower than that of the developing roller while the top thereof is also positioned lower than that of the developing roller.

In a preferred embodiment, a tangent which touches the surface of the supply roller at a point near the top thereof as well as the surface of said developing roller at a point near the top thereof forms an angle of approximately 20 to 40 degrees with the horizontal line.

In a preferred embodiment, the supply roller and the developing roller rotate in such a manner that the respective surfaces of the supply roller and the developing roller move in opposite directions from each other at their contact faces.

Thus, the invention described herein makes possible the objective of providing a developing apparatus in which developer prevented by the regulating member from being further conveyed on the surface of the developing roller falls down by gravity toward the supply roller to be stirred with other developer newly conveyed on the surface of the developing roller toward the regulating member, so that the developer kept back by the regulating member will not accumulate, and thereby preventing the blocking of the developer.

BRIEF DESCRIPTION OF THE DRAWING

This invention may be better understood and its numerous objects and advantages will become apparent to those skilled in the art by reference to the accompanying drawing as follows.

DESCRIPTION OF THE PREFERRED EMBODIMENTS

Figure 1:
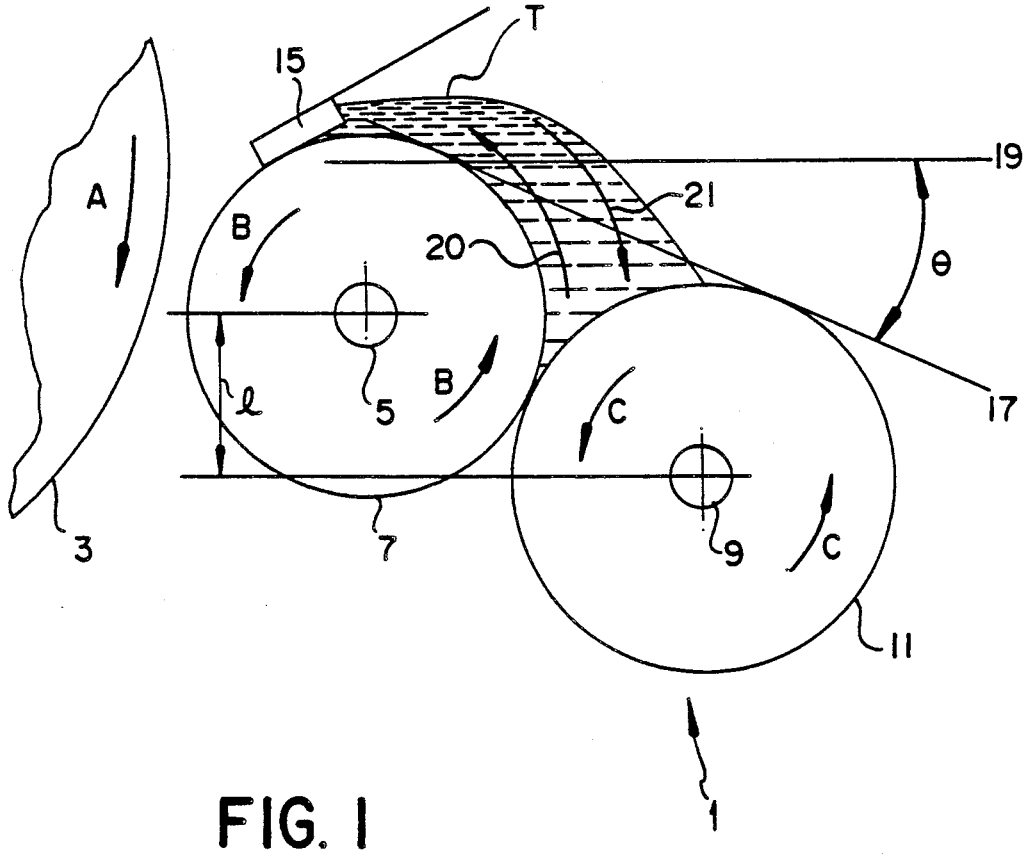
FIG. 1 is a diagrammatic sectional view showing a developing apparatus of the invention.

The following description deals with one embodiment of the present invention.

Referring to FIG. 1, a developing apparatus 1 of the present invention develops an electrostatic latent image formed on a photosensitive drum 3 which functions as an image-holding means. The photosensitive drum 3 rotates in the direction shown by arrow A.

The developing apparatus 1 comprises a developing roller 7 disposed facing the photosensitive drum 3, and a supply roller 11 disposed in contact with the developing roller 7. The developing roller 7 rotates about a rotation axis 5, and conveys developer on the surface thereof by the rotation. The supply roller 11 rotates about a rotation axis 9 to convey developer on the surface thereof and supplies the developer to the developing roller 7. Above the developing roller 7 is disposed a regulating member 15 which regulates the amount of the developer to be conveyed on the surface of the developing roller 7.

The developing roller 7, which is made of, for example, stainless steel coated with silicone resin, rotates in the direction (shown by arrow B) opposite to the rotational direction (shown by arrow A) of the photosensitive drum 3. Thus, the respective surfaces of the developing roller 7 and the photosensitive drum 3 move in the same direction at the portions where they face each other.

The supply roller 11, which is made of, for example, urethane rubber coated with fluorocarbon resin, is so disposed that its axis is positioned lower than that of the developing roller 7 by a distance l. The supply roller 11 rotates in the same direction (shown by arrow C) as the rotational direction of the developing roller 7. Thus, the respective surfaces of the supply roller 11 and the developing roller 7 move in opposite directions from each other at their contact faces.

The top of the supply roller 11 is positioned lower than that of the developing roller 7 in such a manner that a tangent 17 which touches the surfaces of both the rollers at points near the tops thereof forms an angle $\theta$ of approximately 20 to 40 degrees with the horizontal line 19.

The regulating member 15 which regulates the amount of developer to be conveyed on the surface of the developing roller 7 is located slightly away from the top of the developing roller 7 in the direction of the photosensitive drum 3. The regulating member 15, which is made of phosphor bronze, urethane rubber, silicone rubber, or the like, regulates the amount of developer to be conveyed on the surface of the developing roller 7 so as to form a thin layer of the developer with a predetermined thickness on the surface of the developing roller 7. The developer to be formed in a thin layer on the surface of the developing roller 7 is charged through friction with the regulating member 15.

In the developing apparatus 1 of the above construction, the developer is supplied onto the surface of the developing roller 7 by the rotation of the supply roller 11, and is conveyed on the surface of the developing roller 7 in the direction shown by arrow 20 to the regulating member 15. The regulating member 15 prevents further transportation of some of the developer being conveyed in the direction of arrow 20, so that an appropriate amount of the developer is delivered in the direction of the photosensitive drum 3. The developer delivered from the regulating member 15 is formed into a thin layer of a predetermined thickness to be conveyed on the surfaces of the developing roller 7. Developer T prevented by the regulating member 15 from being further conveyed on the surface of the developing roller 7 falls down by gravity and flows toward the supply roller 11 as shown by arrow 21. The developer T is stirred with other developer which is newly supplied by the supply roller 11 onto the surface of the developing roller 7 to be conveyed on the surface of the developing roller 7 toward the regulating member 15. This eliminates the possibility that the developer kept back by the regulating member 15 will accumulate on the upper part of the developing roller 7, thereby preventing the blocking of the developer.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A developing apparatus comprising:

a developing roller which conveys developer, on a surface thereof, by rotating in a predetermined direction, said developer being conveyed to a top of said developing roller and supplied therefrom to an image-holding means to develop a latent image thereon;

a supply roller which rotates to convey said developer to a top thereof to said developing roller, said supply roller and said developing roller keeping contact with each other and moving in opposite directions from each other at contact faces thereof; and a regulating member which regulates an amount of said developer to be conveyed onto the surface of said developing roller, wherein said supply roller is so disposed that an axis thereof is positioned lower than an axis of said developing roller while the top of said supply roller is positioned lower than the top of said developing roller, and a tangent, which extends from a surface of said supply roller at a point near the top thereof as well as extends from the surface of said developing roller at a point near the top thereof, forms an angle of approximately 20 to 40 degrees with a horizontal line.

* * * * *